US009731158B1

(12) United States Patent
Lo

(10) Patent No.: US 9,731,158 B1
(45) Date of Patent: Aug. 15, 2017

(54) WEIGHT TRAINING ASSEMBLY

(71) Applicant: Chiu-Hsiang Lo, Taichung (TW)

(72) Inventor: Chiu-Hsiang Lo, Taichung (TW)

( * ) Notice: Subject to any disclaimer, the term of this patent is extended or adjusted under 35 U.S.C. 154(b) by 0 days.

(21) Appl. No.: 15/140,488

(22) Filed: Apr. 28, 2016

(51) Int. Cl.
*A63B 21/062* (2006.01)

(52) U.S. Cl.
CPC ..... *A63B 21/0628* (2015.10); *A63B 21/063* (2015.10)

(58) Field of Classification Search
CPC . A63B 21/06–21/068; A63B 21/072–21/0783; A63B 21/15–21/159
USPC ..... 482/92–109
See application file for complete search history.

(56) References Cited

U.S. PATENT DOCUMENTS 3,912,261 A * 10/1975 Lambert, Sr. ..... A63B 21/06 482/100
4,546,971 A * 10/1985 Raasoch ..... A63B 21/063 482/100
5,342,271 A * 8/1994 Long ..... A63B 21/0628 482/98
5,350,344 A * 9/1994 Kissel ..... A63B 21/0628 310/15
5,556,362 A * 9/1996 Whipps ..... A63B 21/0628 482/97
5,643,151 A * 7/1997 Naimo ..... A63B 21/063 482/93
6,174,265 B1 * 1/2001 Alessandri ..... A63B 21/0628 482/100
7,413,532 B1 * 8/2008 Monsrud ..... A63B 21/0628 482/98
7,485,076 B2 * 2/2009 Lee ..... A63B 21/00072 482/2
7,614,981 B2 * 11/2009 Cao ..... A63B 21/063 482/98
7,815,554 B2 * 10/2010 Gibson ..... A63B 21/0628 482/100
8,192,334 B2 * 6/2012 Sela ..... A63B 21/0609 482/98
8,777,820 B2 * 7/2014 Lo ..... A63B 21/00065 482/98
9,498,668 B2 * 11/2016 Smith ..... A63B 24/0087
9,604,090 B1 * 3/2017 Meyer ..... A63B 21/062
2004/0009854 A1 * 1/2004 Shiang ..... A63B 21/0609 482/93

* cited by examiner

*Primary Examiner* — Sundhara Ganesan
*Assistant Examiner* — Garrett Atkinson

(57) ABSTRACT

A weight training assembly includes a frame includes a first rail to which a slide member and multiple weights are connected. The slide member has a main rod with multiple through hole. Each weight has a transverse holes and longitudinal holes, each transverse hole has a pin received therein, and each longitudinal hole has a push rod received therein. A first spring is located between the pin and the weight. A second spring is located between the push rod and the weight. A push unit includes a push member which is located corresponding to the front sides of the weights. When the push member pushes the push rod from the first position to the second position, the pin moves from the third position to the third position and extends through one through hole to lock the weight to the main rod.

7 Claims, 8 Drawing Sheets

WEIGHT TRAINING ASSEMBLY

BACKGROUND OF THE INVENTION

1. Fields of the Invention

The present invention relates to a weight training assembly, and more particularly, to a weight training assembly with weights locking device.

2. Descriptions of Related Art

The conventional weight training assemblies known to applicant are disclosed in U.S. Pat. Nos. 6,551,223, 6,974,405, and 7,011,609, and generally comprises a rail with a slide and multiple weights slidably mounted to the rail. The slide has a rod connected thereto which is connected with a force applying unit, and multiple holes are defined through the rod. The users operates the force applying unit to move the slide. Each weight has transverse holes and a longitudinal hole, each transverse hole has a pin received therein, and the rod extends through the longitudinal hole. When in operation, the pin of the desired weight extends through the hole of the rod to lock the weight to the rod. When removing the pin from the hole, the weight is movable and does not positioned to the rod. However, the user have to insert and remove the pins when using the weights, and this may not suitable for some users.

U.S. Pat. No. 8,777,820 develops a sufficient way to allow the users not have to remove the pins to adjust the weights. Nevertheless, the pins can only be inserted into a short depth into the weights and cannot secure the weights.

The present invention intends to provide a weight training assembly to eliminate the shortcomings mentioned above.

SUMMARY OF THE INVENTION

The present invention relates to a weight training assembly and comprises a frame which includes a first rail to which a slide member and multiple weights are connected. The slide member has a main rod with multiple through hole. Each weight has a transverse holes and longitudinal holes, each transverse hole has a pin received therein, and each longitudinal hole has a push rod received therein. A first spring is located between the pin and the weight. A second spring is located between the push rod and the weight. A push unit includes a push member which is located corresponding to the front sides of the weights. When the push member pushes the push rod from the first position to the second position, the pin moves from the third position to the third position and extends through one through hole to lock the weight to the main rod.

The primary object of the present invention is to provide a weight training assembly wherein the weights are adjusted and secured by operating a push unit without pulling pins and inserting pins by the users.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 2-1 is an enlarged view of the circled "A" in FIG. 2;

FIG. 3-1 is an enlarged view of the circled "B" in FIG. 3;

DETAILED DESCRIPTION OF THE PREFERRED EMBODIMENT

Figure 1:
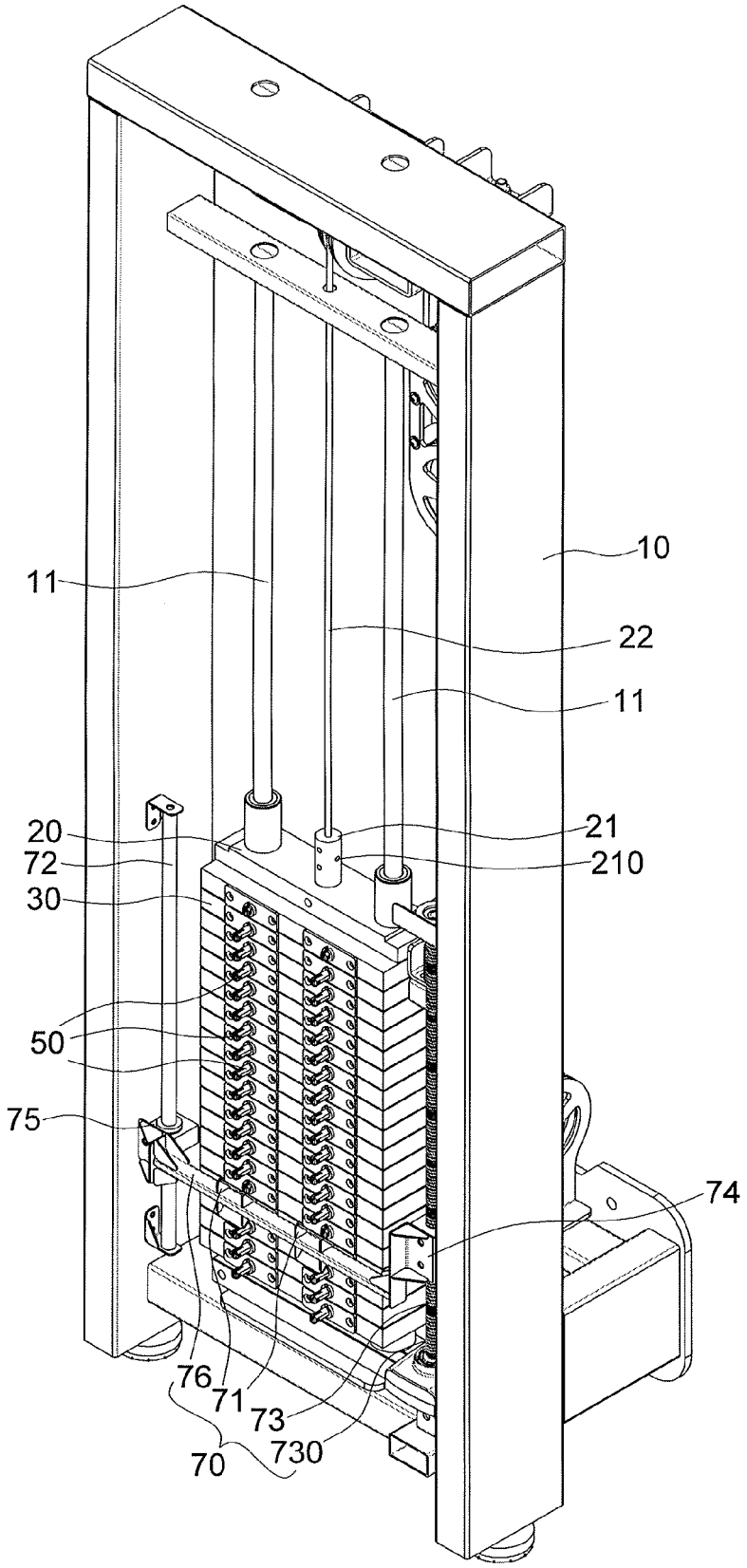
FIG. 1 is a perspective view of the weight training assembly of the present invention.

Referring to FIGS. 1 to 8, the weight training assembly of the present invention comprises a frame 10 having two rails 11 connected thereto. A slide member 20 is movably connected to the rails 11 and has a main rod 21 connected thereto, wherein the main rod 21 is a solid and cylindrical rod, and multiple through holes 210 are defined through the main rod 21.

A force applying unit 22 is connected to the slide member 20 so that users operate the force applying unit 22 to move the slide member 20 up and down.

Figure 6:
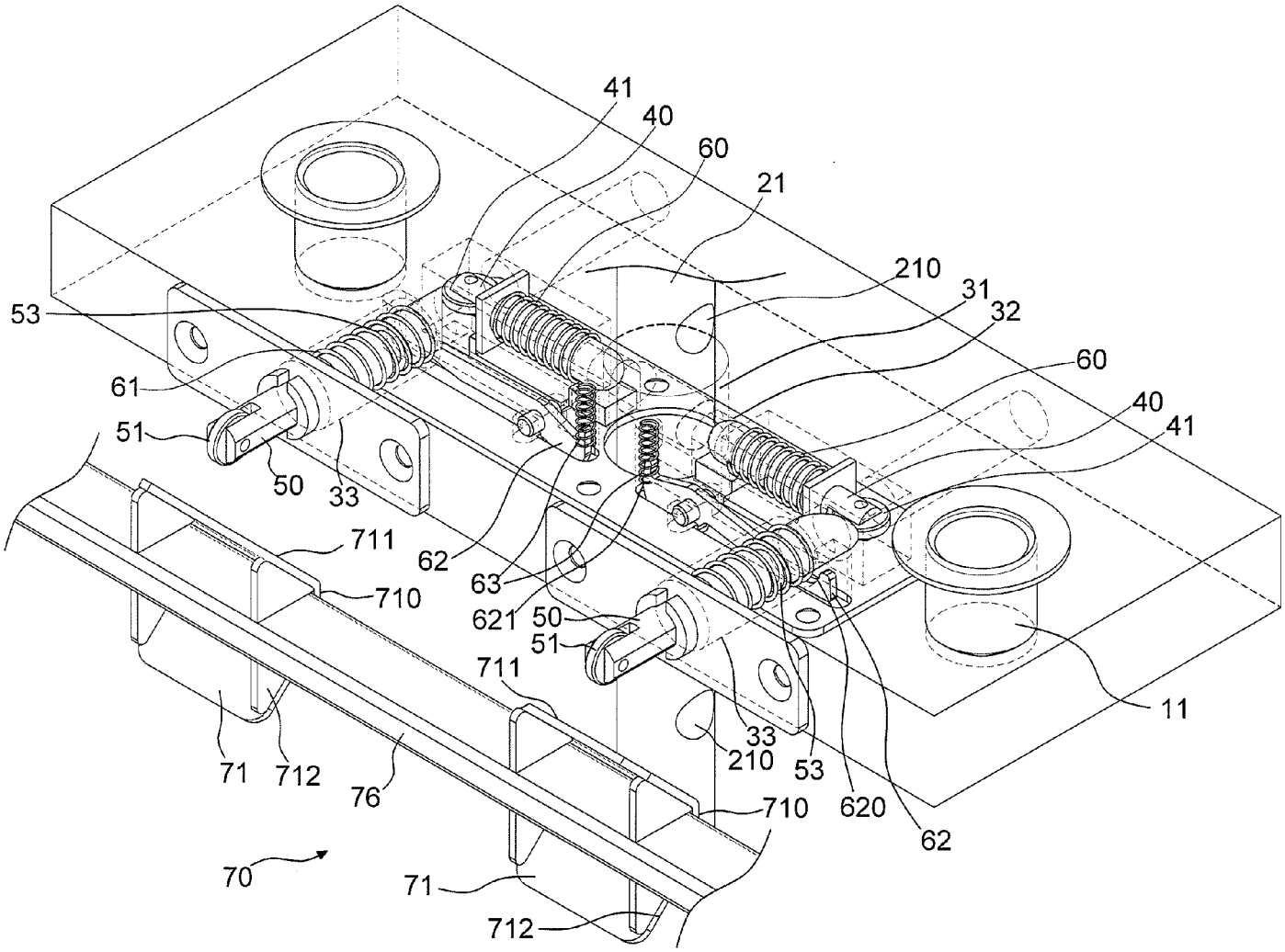
FIG. 6 shows a single weight of the weight training assembly of the present invention.
Figure 7:
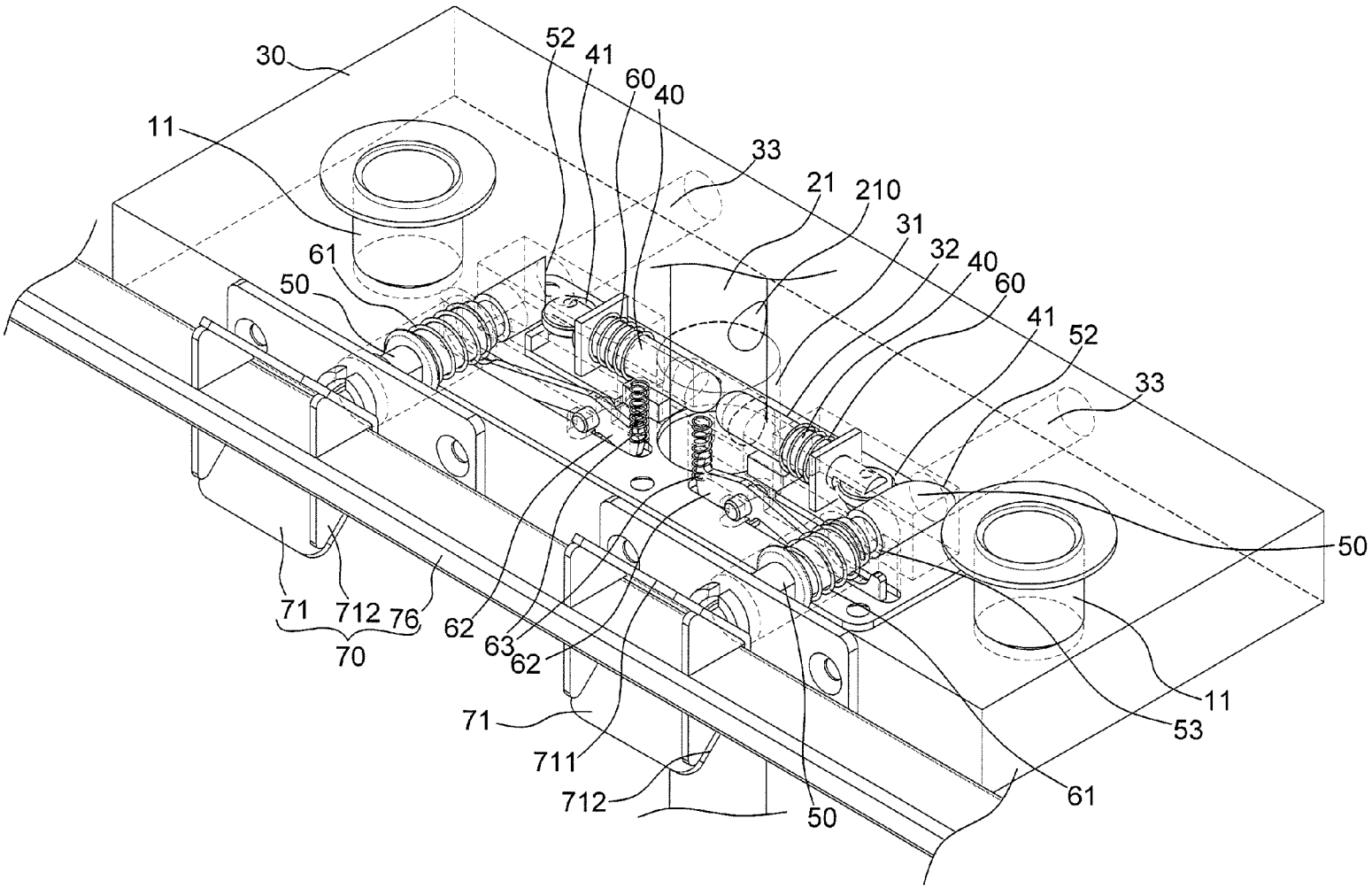
FIG. 7 shows that the push unit operates to the single weight of the weight training assembly of the present invention.
Figure 8:
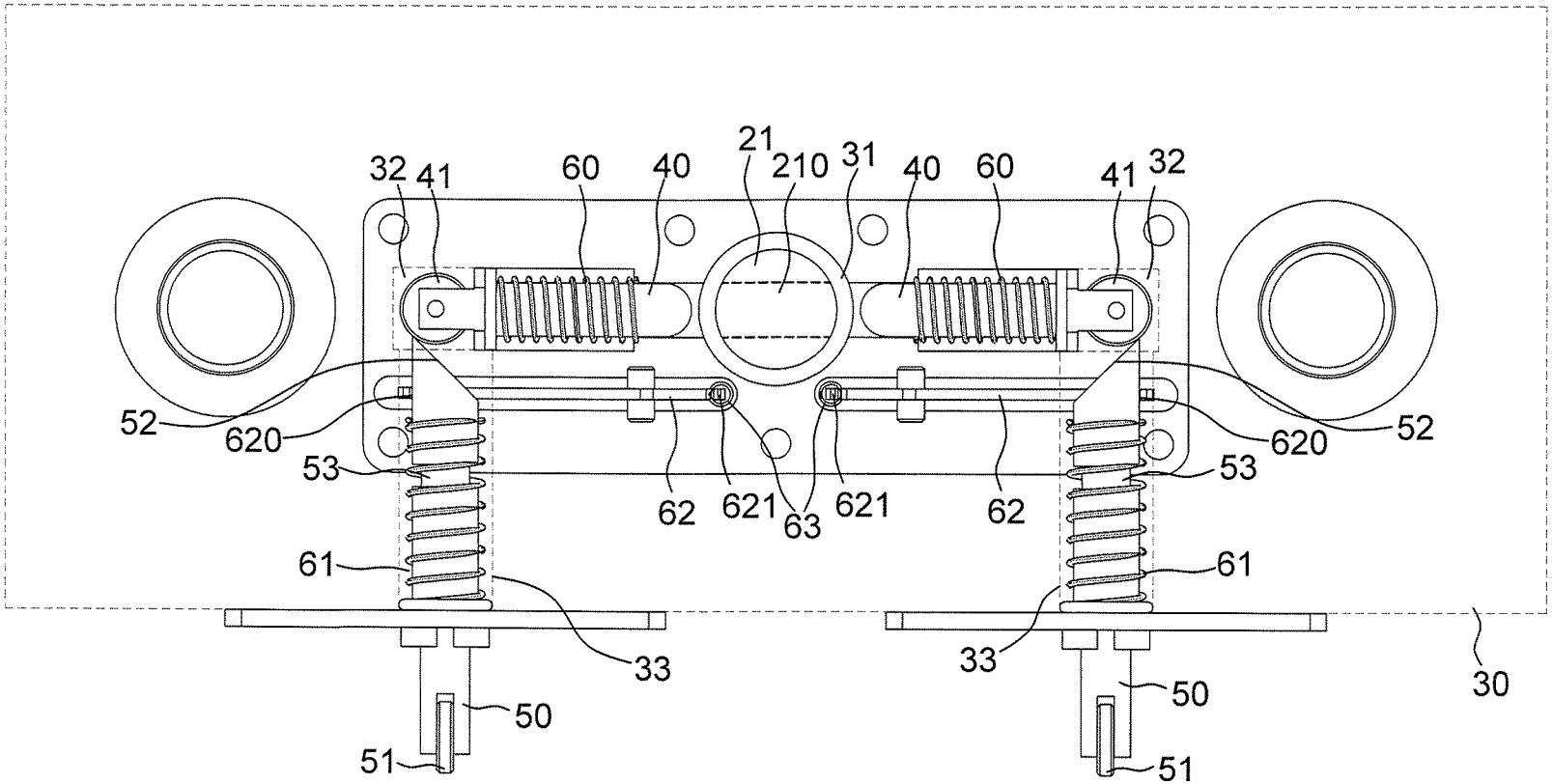
FIG. 8 is a top view to show the structure of the single weight of the weight training assembly of the present invention.

Multiple weights 30 are movably mounted to the rails 11 and each weight 30 has a passage 31 defined axially therethrough, and the main rod 21 extends through the passage 31. Each weight 30 has two transverse holes 32 and two longitudinal holes 33. Each of the transverse holes 32 and the longitudinal holes 33 has a first end and a second end. The two transverse holes 32 are co-axially located in the weight 30 and located on two sides of the passage 31. The two respective first ends of the transverse holes 32 communicate with the passage 31. The two respective second ends of the two transverse holes 32 are located respectively corresponding to the two respective first ends of the two longitudinal holes 33. The two respective second ends of the two longitudinal holes 33 communicate through the front side of the weight corresponding thereto. As shown in FIGS. 6 to 8, the angle between each of the transverse holes 32 and each of the longitudinal holes 33 is 90 degrees.

As shown in FIGS. 6 to 8, multiple pins 40 each have a first end and a second end, and each transverse hole 32 has one pin 40 received therein. The first and second ends of the pin 40 are respectively located at the first and second end of the transverse hole 32. Multiple push rods 50 each have a first end and a second end, and each push rod 50 has a first notch 53 defined in the outside thereof. Each longitudinal hole 33 of each weight 30 has one of the push rods 50 located therein. The first end of the push rod 50 is located at the first end of the longitudinal hole 33, and the second end of the push rod 50 protrudes from the second end of the longitudinal hole 33 and protrudes from the front side of the weight 30.

As shown in FIGS. 4 to 8, multiple first springs 60 each are located between the pin 40 and the weight 30 corresponding thereto so as to provide a first recovery force to the pin 40. Multiple second springs 61 each are located between the push rod 50 and the weight 30 corresponding thereto so as to provide a second recovery force to the push rod 50.

Figure 5:
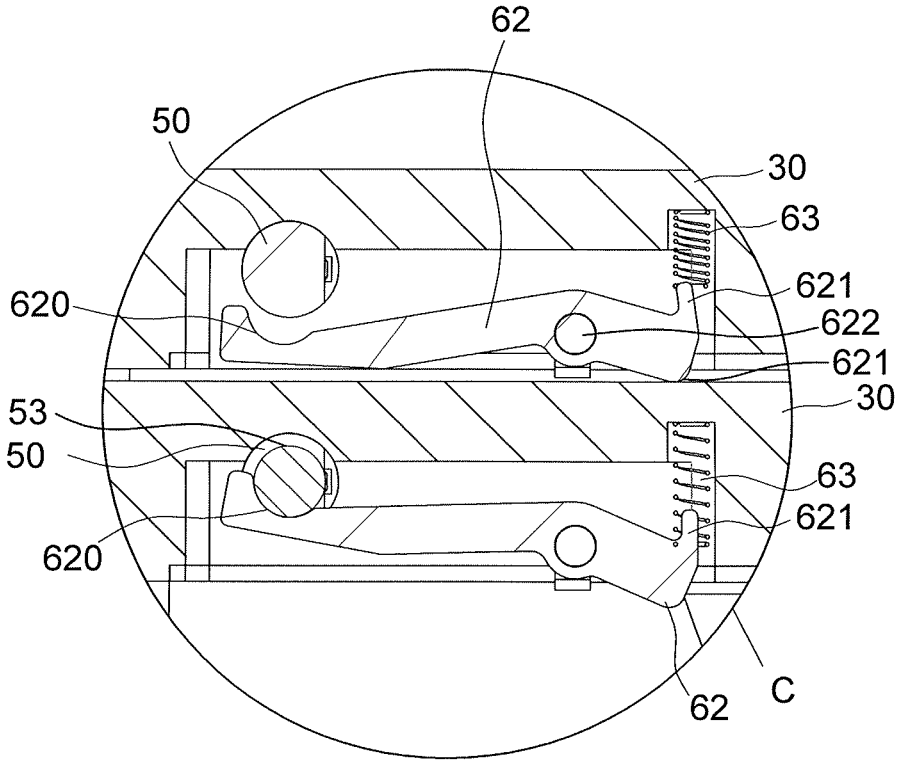
FIG. 5 is an enlarged cross sectional view of the circled "C" in FIG. 4.

Referring to FIG. 5, multiple engaging members 62 each have a pivot 622 located between two ends thereof, and the pivot 622 is pivotably connected to the weight 30 corresponding thereto. A second notch 620 and a hook portion 621 are respectively formed on the two ends of each engaging member 62. The hook portion 621 protrudes beyond the underside of the weight 30 corresponding thereto. Multiple third springs 63 each are located between the engaging member 62 and the weight 30 corresponding thereto to provide a third recovery force to the engaging member 62. When the bottom of the upper weight 30 places on the top of lower weight 30, the hook portion 621 of the upper weight 30 is pushed by the top of lower weight 30 so that the second notch 620 disengages with the first notch 53, and the third springs 63 is compressed to produce a third recovery force.

Figure 3:
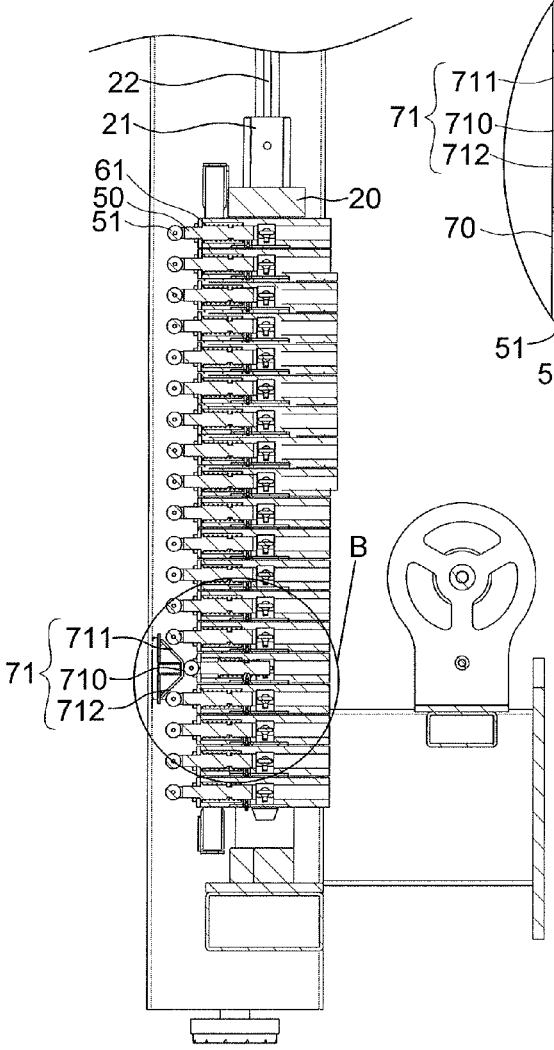
FIG. 3 is a partial side cross sectional view of the weight training assembly of the present invention.
Figures 1, 3:
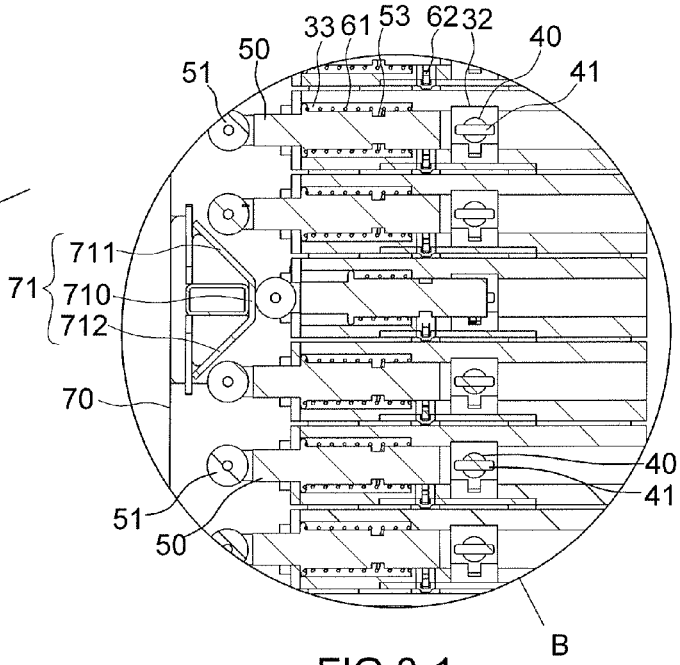
Figure 4:
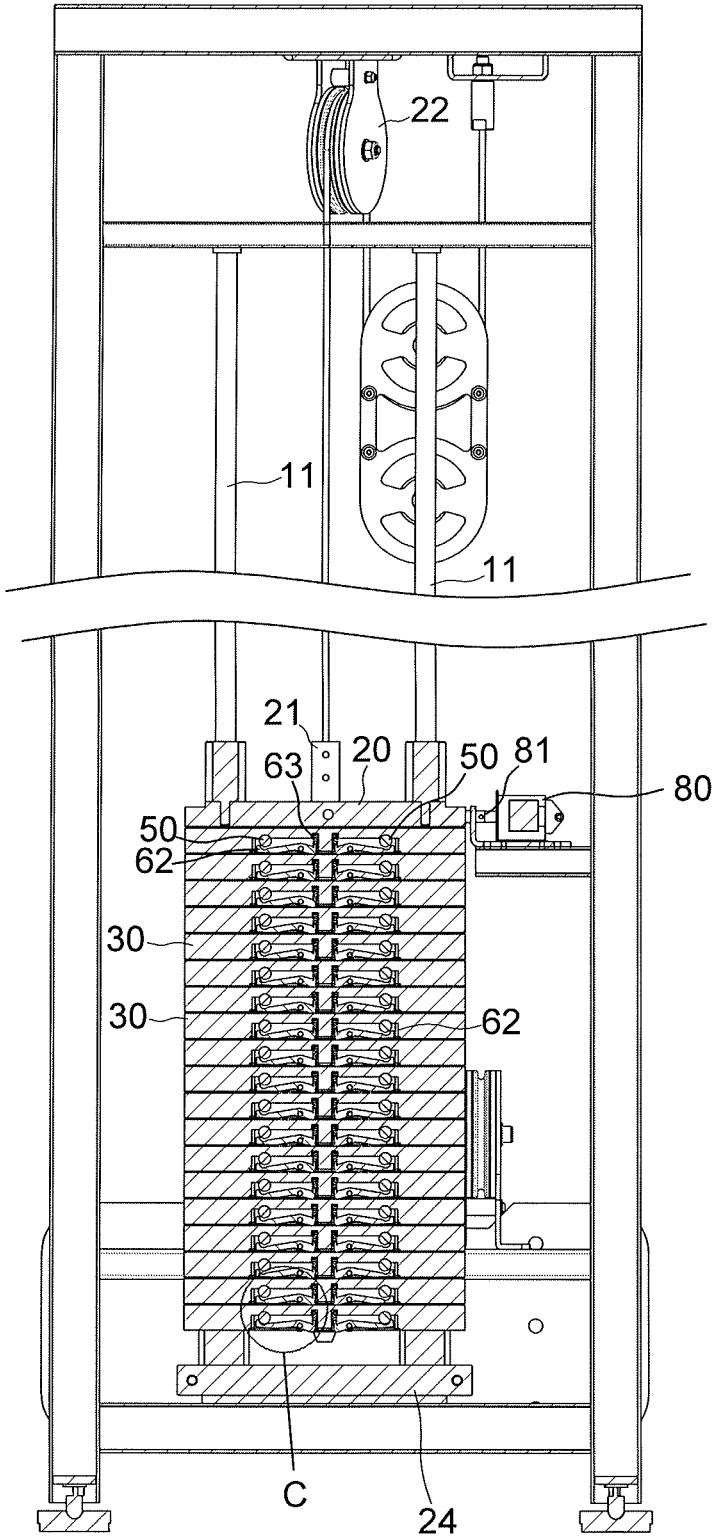
FIG. 4 is another partial side cross sectional view of the weight training assembly of the present invention.

As shown in FIGS. 1 and 3, a push unit 70 has a push member 71 which is located corresponding to the front sides of the weights 30. The push unit 70 is movable up and down along the frame 10.

As shown in FIGS. 1, 3 and 6 to 7, when the users want to adjust the weights 30, the push member 71 of the push unit 70 is moved to the front side of one of the weights 30, so that the push member 71 pushes the second end of the push rod 50 which is moved from a first position to a second position. The second spring 61 is compressed and generates the second recovery force. Then, the first end of the push rod 50 pushes the second end of the pin 40, and the pin 40 moves from a third position to a fourth position. The first spring 60 is compressed and generates the first recovery force, so that the first end of the pin 40 extends through one of the through holes 210 of the main rod 21 to secure the weight 30 to the main rod 21. On the other hand, when the slide member 20 and the weight 30 that the users choose are lifted, because the hook portion 621 of the engaging member 62 is disengaged from the weight 30 below or from the lowest block 24, so that the third spring 63 release the third recovery force to the engaging member 62 to pivot the engaging member 62, so that the engaging member 62 moves from a fifth position to a sixth position so as to engage the second notch 620 of the engaging member 62 with the first notch 53 of the push rod 50 to position the push rod 50. The first end of the pin 40 extends through one of the through holes 210 of the main rod 21 to secure the weight 30 to the main rod 21, the users are then able to lift the weight 30.

When the users want to release the locked status of the weight 30, the users operate the force applying unit 22 to let the chosen weight 30 and the slide member 20 be slowly lowered and rested on the block 24. Under this status, the push member 71 is controlled to be removed from the chosen weight 30, because the underside of the weight 30 is rested on the top of the weight below, so that the hook portion 621 contacts the top surface of the weight 30 below and the third spring 62 is compressed. The engaging member 62 of the top weight 30 moves from the sixth position to the fifth position so that the second notch 620 of the engaging member 62 is lowered and disengaged from the first notch 53 of the push rod 50. The locked status of the push rod 50 is released. On the other hand, the push rod 50 is applied by the second recovery force and moves from the second position to the first position. The pin 40 is applied by the first recovery force and moves from the fourth position to the third position. Therefore, the first end of the pin 40 is removed from the through hole 210 of the main rod 21, so that the weight 30 and the main rod 21 are not connected to each other.

As shown in FIGS. 1, 3 and 3-1, the push member 71 includes an push face 710 to push the second end of the push rod 50, a top inclined face 711 connected to one end of the push face 710, and a bottom inclined face 712 connected to the other end of the push face 710. The top inclined face 711 and the bottom inclined face 712 allow the push face 710 to move over one end of the push rod 50 smoothly. When adjusting the weights 30 and the push member 71 moves upward, the top inclined face 711 moves over the second end of the push rod 50, and the push face 710 contacts the second end of the push rod 50, the push rod 50 moves from the first position to the second position. Because the user did not lift the weight 30, so that the push rod 50 is not locked by the engaging member 62 yet. When the push member 71 continuously moves upward and the bottom inclined face 712 moves over the second end of the push rod 50, the push face 710 departs from the push rod 50, and the push rod 50 moves from the second position to the first position by the second recovery force of the second springs 61. The above steps repeatedly processed until the push member 71 is located the desired positions where the push face 710 of the push member 71 faces to one chosen weight 30 and total amount of weights 30 is chosen, and the push face 710 pushes the second end of the push rod 50 of the chosen weight 30, the push rod 50 of the chosen weight 30 moves from the first position to the second position. When the chosen weight 30 is lifted gradually, the hook portion 621 depart from the top of the lower weight 30, the engaging member 62 moves from the fifth position to the sixth position so that the second notch 620 of the engaging member 62 engages with the first notch 53 of the push rod 50 to position the push rod 50 at the second position and the pin 40 at the fourth position, the first end of the pin 40 extends through one of the through holes 210 of the main rod 21 to secure the weight 30 to the main rod 21, and then the users are able to lift the weight 30.

When the push member 71 continuously moves downward, the above steps are proceeded in reverse sequences. The bottom inclined face 712 moves over the second end of the push rod 50, and the push face 710 contacts the second end of the push rod 50, and then the top inclined face 711 moves over the second end of the push rod 50. It is noted that when the push member 71 is positioned at a higher push rod 50, the load to the users is lighter. One contrary, when the push member 71 is positioned at a lower push rod 50, the load to the users is heavier.

As shown in FIG. 1, the push unit 70 has a second rail 72, an electric threaded rod unit 73 having a threaded rod 730 and parallel to the second rail 72, a seat 74 threadedly connected to the threaded rod 730, a movable part 75 movable along the second rail 72, and a transverse bar 76 located between the seat 74 and the movable part 75. There are two push members 71 connected to the transverse bar 76. The rotational direction of the electric threaded rod unit 73 can be controlled by operation to the control circuit so as to move the two push members 71 up and down along the threaded rod 730 and the second rail 72.

As shown in FIGS. 3 and 6 to 8, wherein a first roller 51 is connected to the second end of each of the push rods 50. The push member 71 contacts the first roller 51 to push the push rod 50. The first end of the push rod 50 has an inclined face 52. A second roller 41 is connected to the second end of the pin 40. The second roller 41 is pushed by the inclined face 52. The first end of the pin 40 extends through one of the through holes 210.

Figure 2:
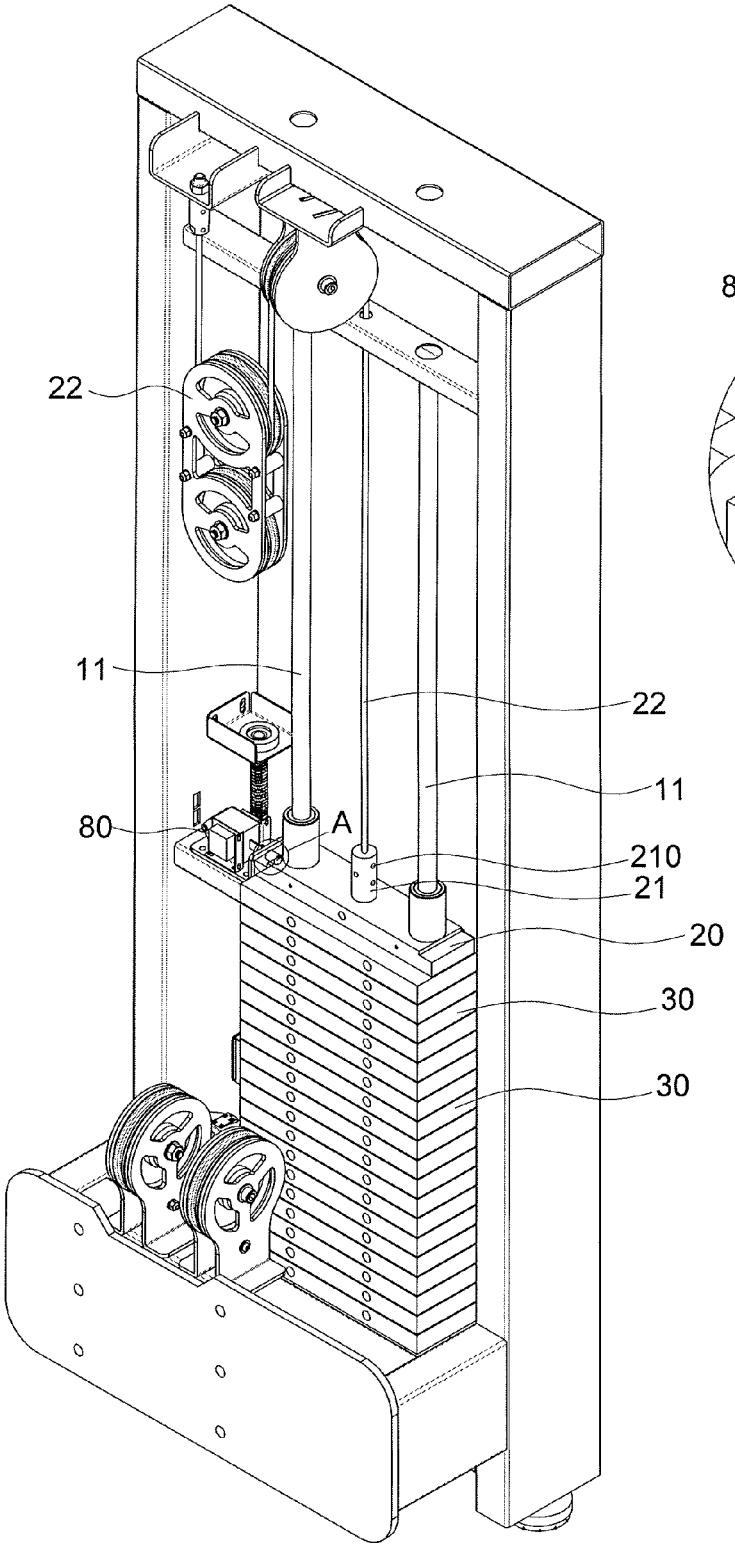
FIG. 2 is another perspective view of the weight training assembly of the present invention.
Figures 1, 2:
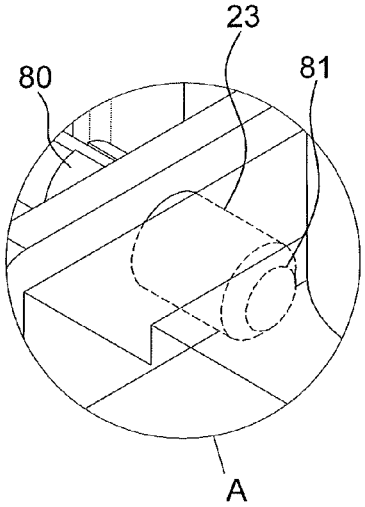

As shown in FIGS. 1, 2 and 2-1, the slide member 20 has an engaging hole 23, and the frame 10 has a latch unit 80 (such as an electro-magnetic valve) located next to the slide member 20. The latch unit 80 includes a retractable latch 81. When the retractable latch 81 extends into the engaging hole 23, the slide member 20 is not movable, and when the retractable latch 81 removed from the engaging hole 23, the slide member 20 is movable.

While we have shown and described the embodiment in accordance with the present invention, it should be clear to those skilled in the art that further embodiments may be made without departing from the scope of the present invention.

What is claimed is:

1. A weight training assembly comprising:

a frame having at least one rail connected thereto;

a slide member movably connected to the at least one rail and having a main rod connected thereto, multiple through holes defined through the main rod;

a force applying unit connected to the slide member so that users operate the force applying unit to move the slide member;

multiple weights movably mounted to the at least one rail and each weight having a passage defined axially therethrough, the main rod extending through the passage, each weight having two transverse holes and two longitudinal holes, each of the transverse holes and the longitudinal holes having a first end and a second end, the two transverse holes co-axially located in the weight and located on two sides of the passage, the two respective first ends of the transverse holes communicating with the passage, the two respective second ends of the two transverse holes located respectively corresponding to the two respective first ends of the two longitudinal holes, the two respective second ends of the two longitudinal holes communicating through a front side of the weight corresponding thereto;

multiple pins each having a first end and a second end, each transverse hole having one pin received therein, the first and second ends of the pin respectively located at the first and second end of the transverse hole;

multiple push rods each having a first end and a second end, each push rod having a first notch defined in an outside thereof, each longitudinal hole of each weight having one of the push rods located therein, the first end of the push rod located at the first end of the longitudinal hole, the second end of the push rod protruding from the second end of the longitudinal hole and protruding from the front side of the weight;

multiple first springs each located between the pin and the weight corresponding thereto to provide a first recovery force to the pin;

multiple second springs each located between the push rod and the weight corresponding thereto to provide a second recovery force to the push rod;

multiple engaging members each having a pivot located between two ends thereof, the pivot pivotably connected to the weight corresponding thereto, a second notch and a hook portion respectively formed on the two ends of each engaging member, the hook portion protruding beyond an underside of the weight corresponding thereto;

multiple third springs each located between the engaging member and the weight corresponding thereto to provide a third recovery force to the engaging member;

a push unit having a push member which is located corresponding to the front sides of the weights, the push unit being movable along the frame, and when the push member moves to the front side of one of the weights, the push member pushes the second end of the push rod which is moved from a first position to a second position, the second spring generates the second recovery force, the second notch of the engaging member is engaged with the first notch of the push rod to position the push rod, the first end of the push rod pushes the second end of the pin, the pin moves from a third position to a fourth position, the first spring generates the first recovery force, the first end of the pin extends through one of the through holes of the main rod to secure the weight to the main rod, the second notch of the engaging member is located corresponding to the first notch of the push rod, the engaging member is applied by the third recovery force and moves from a fifth position to a sixth position so as to engage the second notch of the engaging member with the first notch of the push rod to position the push rod, when the push member removes from the front side of the weight corresponding thereto and the underside of the weight is rested on a top of a next weight, the engaging member of the top weight moves from the sixth position to the fifth position so that the second notch of the engaging member is lowered and disengaged from the first notch of the push rod, the push rod is applied the second recovery force and moves from the second position to the first position, the pin is applied by the first recovery force and moves from the fourth position to the third position.

2. The weight training assembly as claimed in claim 1, wherein the main rod is a solid and cylindrical rod.

3. The weight training assembly as claimed in claim 1, wherein the push member includes a push face to push the second end of the push rod, a top inclined face connected to one end of the push face, and a bottom inclined face connected to the other end of the push face.

4. The weight training assembly as claimed in claim 1, wherein a first roller is connected to the second end of each of the push rods, the push member contacts the first roller to push the push rod, the first end of the push rod has an inclined face, a second roller is connected to the second end of the pin, the second roller is pushed by the inclined face, the first end of the pin extends through one of the through holes.

5. The weight training assembly as claimed in claim 1, wherein the slide member has an engaging hole, the frame has a latch unit located next to the slide member, the latch unit includes a retractable latch, when the retractable latch extends into the engaging hole, the slide is not movable, when the retractable latch removed from the engaging hole, the slide is movable.

6. The weight training assembly as claimed in claim 1, wherein the push unit has a second rail, an electric threaded rod unit having a threaded rod and parallel to the second rail, a seat threadedly connected to the threaded rod, a movable part movable along the second rail, and a transverse bar located between the seat and the movable part, two push members are connected to the transverse bar.

7. The weight training assembly as claimed in claim 1, wherein an angle between each of the transverse holes and each of the longitudinal holes is 90 degrees.

* * * * *